US007639191B2

(12) United States Patent
Andersson et al.

(10) Patent No.: US 7,639,191 B2
(45) Date of Patent: Dec. 29, 2009

(54) MULTI BEAM REPEATER ANTENNA FOR INCREASED COVERAGE

(75) Inventors: Mats H. Andersson, Göteborg (SE); Paul Hallbjörner, Mölndal (SE); Anders Rydberg, Uppsala (SE)

(73) Assignee: Telefonaktiebolaget L M Ericsson (PUBL), Stockholm (SE)

( * ) Notice: Subject to any disclaimer, the term of this patent is extended or adjusted under 35 U.S.C. 154(b) by 21 days.

(21) Appl. No.: 11/994,467

(22) PCT Filed: Jul. 4, 2005

(86) PCT No.: PCT/SE2005/001080

§ 371 (c)(1),
(2), (4) Date: Jan. 2, 2008

(87) PCT Pub. No.: WO2007/004929

PCT Pub. Date: Jan. 11, 2007

(65) Prior Publication Data

US 2008/0198076 A1 Aug. 21, 2008

(51) Int. Cl.
*H01Q 1/24* (2006.01)

(52) U.S. Cl. ..... 343/702; 343/700 MS

(58) Field of Classification Search ..... 343/702, 343/700 MS, 846

See application file for complete search history.

(56) References Cited

U.S. PATENT DOCUMENTS

| | | | | |
|---|---|---|---|---|
| 6,967,623 | B2 * | 11/2005 | Hirota | 343/702 |
| 7,123,196 | B2 * | 10/2006 | Masaki | 343/702 |
| 7,142,886 | B2 * | 11/2006 | Murayama et al. | 455/556.1 |
| 7,196,668 | B2 * | 3/2007 | Lin et al. | 343/702 |
| 7,372,406 | B2 * | 5/2008 | Shiotsu et al. | 343/700 MS |
| 2003/0179138 | A1 | 9/2003 | Chen | |
| 2004/0070543 | A1 * | 4/2004 | Masaki | 343/702 |
| 2004/0130494 | A1 | 7/2004 | Fukushima et al. | |
| 2006/0290575 | A1 * | 12/2006 | Pelzer | 343/702 |

FOREIGN PATENT DOCUMENTS

| | | | |
|---|---|---|---|
| EP | 086558 | A | 8/1983 |
| EP | 1079296 | A | 2/2001 |
| WO | WO 9009042 | A | 8/1990 |
| WO | WO 2005034102 | A | 4/2005 |

* cited by examiner

*Primary Examiner*—Hoang V Nguyen
(74) *Attorney, Agent, or Firm*—Michael G. Cameron

(57) ABSTRACT

The invention discloses an electronics device for personal use, comprising at least a first main surface, and at least a first antenna for communication via electromagnetic waves between the device and a second party. The antenna is an array antenna comprising at least a first and a second antenna element, and is arranged on said first main surface. Suitably, the electronics device is a portable computer comprising a lid which may be opened or closed, said first main surface being the lid, so that the antenna is arranged in the lid of the portable computer.

6 Claims, 6 Drawing Sheets

MULTI BEAM REPEATER ANTENNA FOR INCREASED COVERAGE

This application claims the benefit of PCT Patent Application No. PCT/SE2005/001080, filed Jul. 4, 2005, the disclosure of which is fully incorporated herein by reference.

TECHNICAL FIELD

The present invention discloses an electronics device such as a computer for personal use. The device comprises at least a first main surface, and at least a first antenna for communication via electromagnetic waves between the computer and a second party.

BACKGROUND ART

There are a number of known wireless technologies which may be used for connecting electronics devices such as computers to, for example, a network or to each other. Examples of known such systems are 3G, WiMAX, and WLAN. Most such existing systems move toward higher and higher bit rates, and one way of achieving such an increased bit rate is to use so called MIMO technology (Multiple Input, Multiple Output).

One way of achieving MIMO is to use several antennas with outputs which are decorrelated with respect to each other (uncorrelated antennas). It is known to equip computers, especially portable computers ("laptop" computers), with several orthogonal and thus decorrelated antennas. However, known such antenna systems utilize the available surfaces on the computer in order to make the coupling between the antennas as small as possible by spacing them as widely apart as possible.

The area available on the computer is thus not used to efficiently increase the "link budget".

DISCLOSURE OF THE INVENTION

As described above, there is thus a need for an antenna system for a computer, and a computer with such an antenna system, in which the antenna system makes it possible to use MIMO technology with a high performance "link budget" for a connection between the computer and a second party such as another computer or a wireless network in which the computer is comprised.

This need is addressed by the present invention in that it offers a computer for personal use, which comprises at least a first main surface. In addition, the computer of the invention comprises at least a first antenna for communication via electromagnetic waves between the computer and a second party, the antenna being an array antenna which comprises at least a first and a second antenna element. Said array antenna is arranged on said first main surface, which, if the computer is a portable computer comprising a lid which may be opened or closed, may be the lid.

In one embodiment of the invention, the antenna can comprise a first and a second connection port, each of which is associated with one beam of the antenna.

Also, the array antenna is suitably a travelling wave antenna, but may also be an array antenna with the elements arranged in a Butler matrix.

BRIEF DESCRIPTION OF THE DRAWINGS

The invention will be described in more detail in the following description, with reference to the appended drawings, in which.

EMBODIMENTS OF THE INVENTION

Figure 1:
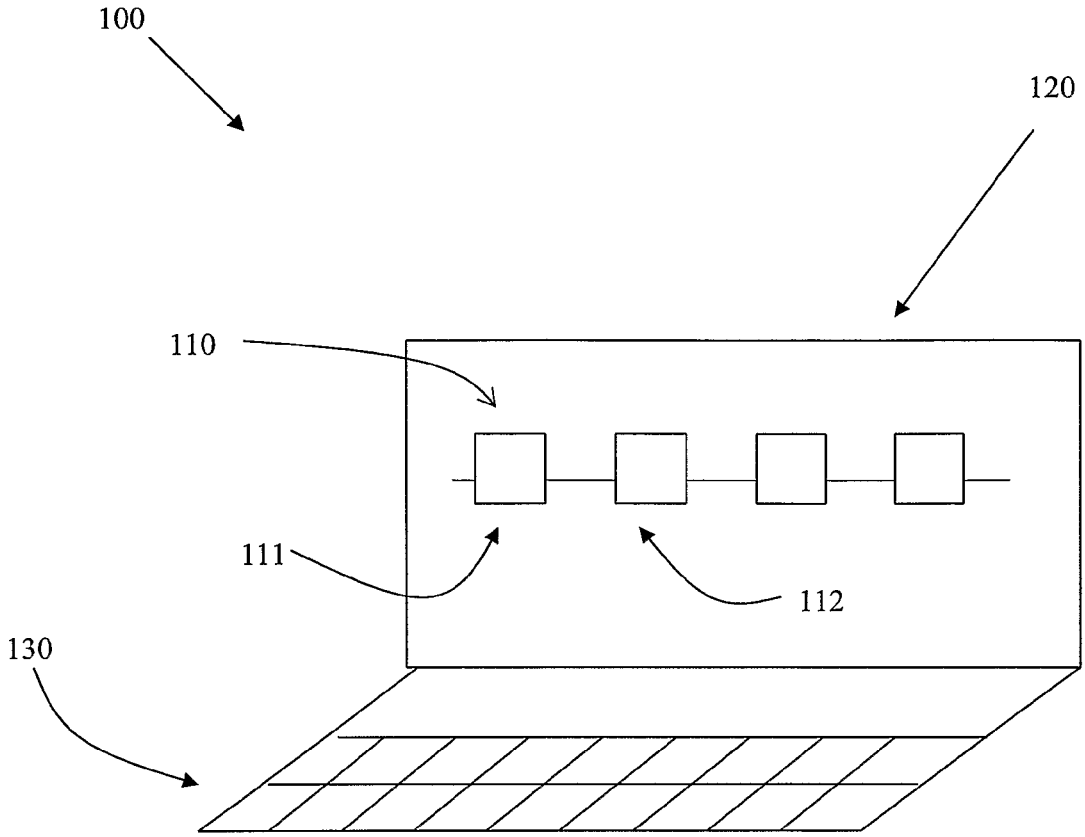
FIG. 1 shows a schematic drawing of a first embodiment of the invention.

FIG. 1 shows a first embodiment of an electronics device according to the invention, in this example shown as a personal computer 100. The computer 100 shown in FIG. 1 is a portable computer (a "laptop"), but as will be described later on, the invention may be applied equally well to other kinds of personal computers and electronics devices.

The computer 100 is in wireless electromagnetic communication with a second user, either another computer or a network which the computer is part of. For said communication, the computer 100 uses an array antenna 110 which is arranged on or in the lid 120 of the computer 100. Naturally, the array antenna can also be arranged on or in the "main body" 130 of the computer.

The array antenna 110 comprises a number of antenna elements, among which are at least a first 111 and a second 112 antenna element. The array antenna as such is chosen from among a number of well known designs for such antennas, all of which provide essentially flat antennas, so that the antenna can be housed as an outer "layer" on the computer's lid or body, as an alternative to which it may be housed in the lid or the body of the computer, covered by, for example, a "radome", i.e. a cover which is essentially electromagnetically transparent.

Figure 2:
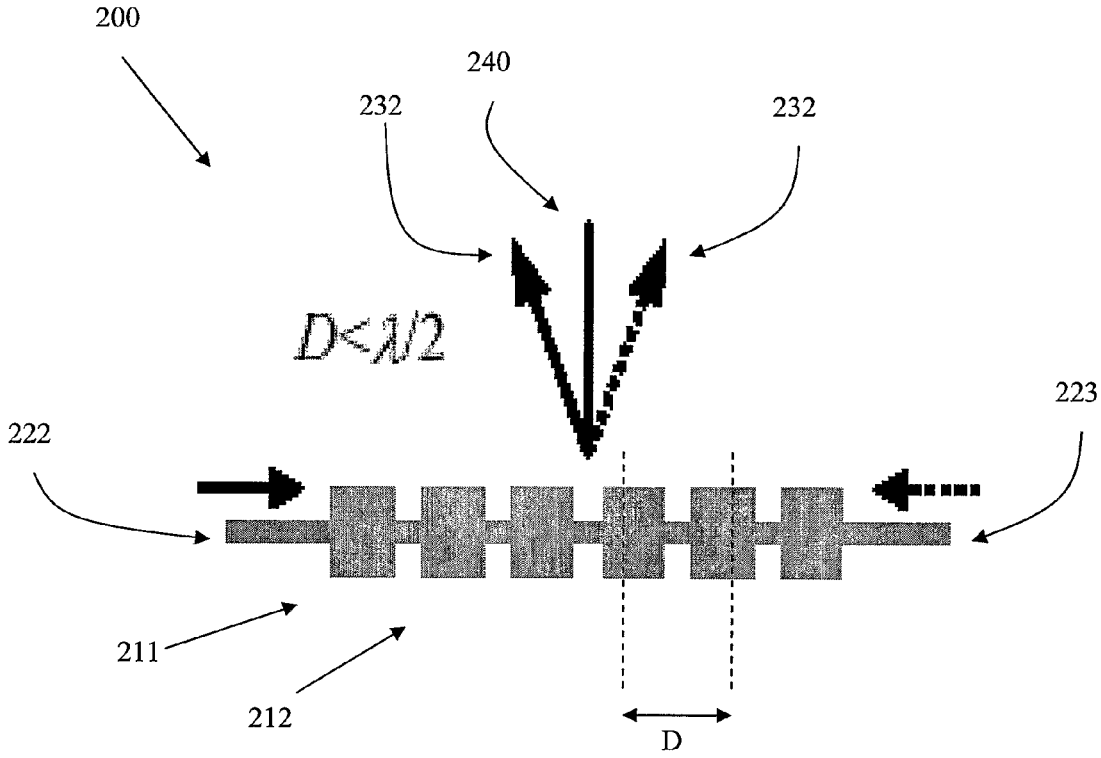
FIGS. 2-5 show various antennas which may be use in a computer of the invention and FIG. 6 shows an alterative computer according to the invention.

FIG. 2 shows an example of an antenna 200 which may be used in a computer 100 of he invention. The antenna 200 is an array antenna of the so called "travelling wave" type, with at least a first 211 and a second 212 radiation element, which are arranged in series at a centre distance D from each other. Since the radiation elements are connected serially to each other there will be a first and a second "end element" to which are attached input/output ports 222, 223, of the array antenna 200.

As shown in FIG. 2, the antenna 200 has a first and a second antenna beam 232, 233, each of which is associated with one of the antenna ports 222, 223. This means that the first beam 232 may be used by accessing the first port 222, and in a similar way the second beam 233 is associated with the second port 223. The angle between the beams is determined by the centre distance D between the antenna elements of the antenna.

As can also be seen in FIG. 2, the two antenna beams of the travelling wave antenna are each other's "mirror image" with respect to an imagined line 240 which extends in a direction perpendicular to the antenna. Thus, the two beams are sometimes referred to as the "plus" or the "minus"-directions.

As shown, a flat antenna is used which may offer a multitude of beams in order to obtain the decorrelation between the antenna beams which is desired, at the same time as the array antenna, being an essentially flat antenna can be housed in the computer in an elegant manner, as described above.

Figure 3:
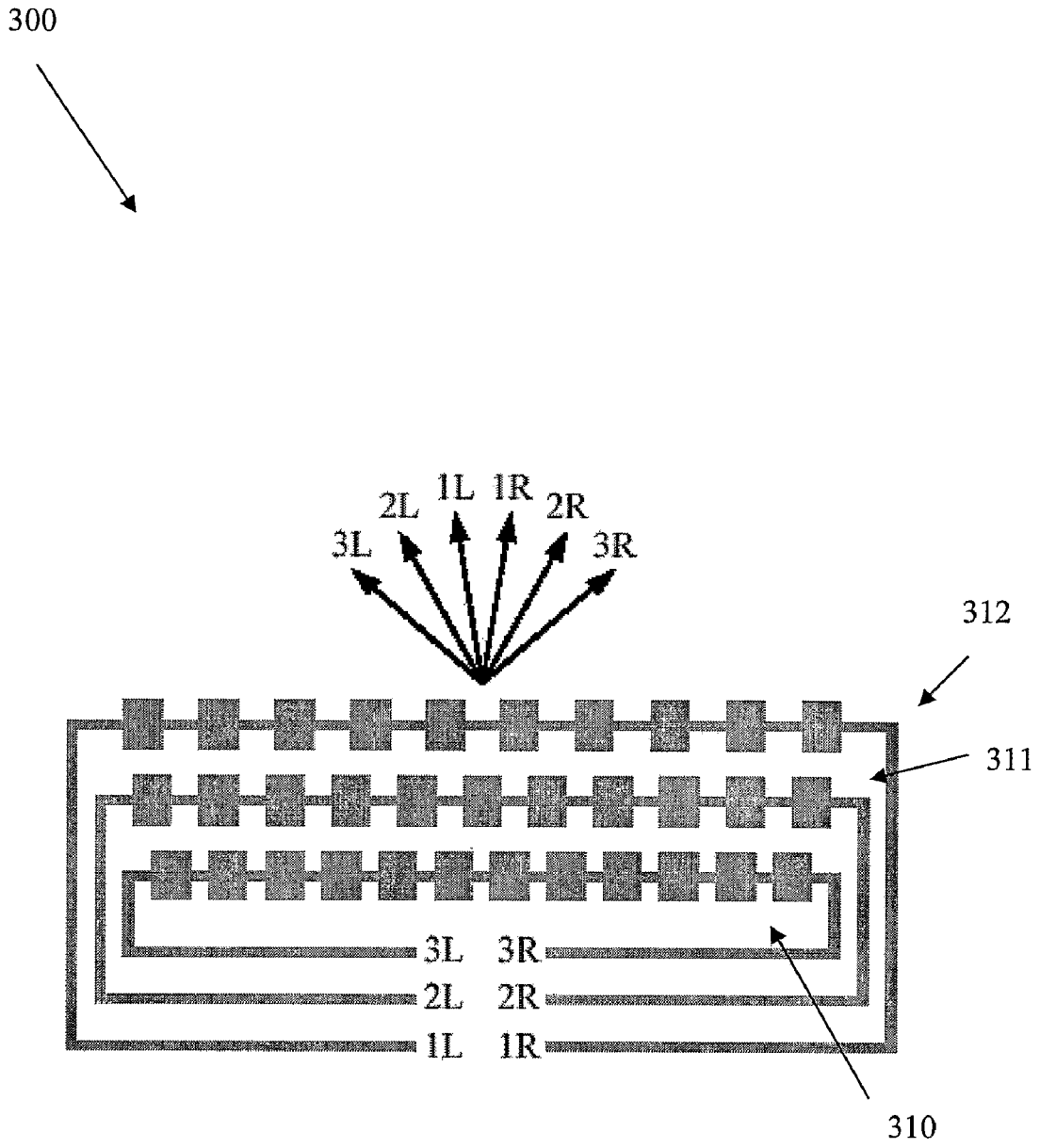

FIG. 3 shows another version 300 of the antenna which may also be used in a computer of the invention. The antenna 300 is comprised of a plurality of travelling wave antennas of the kind shown and described in connection to FIG. 2. In FIG. 3, three antennas 310, 311, 312, are shown, although the number of antennas may naturally be varied rather freely.

In accordance with the principle described earlier, the use of three travelling wave antennas will result in six different antenna beams 321-327, each associated with one of six different antenna ports 331-337.

If the antenna 300 is used for MIMO reception, this may be carried out in the following manner: if there are N MIMO beams and M antenna beams, with M>N, the received signal quality is measured, constantly or at intervals, on each of the M antenna ports. The signals from those ports which have the highest signal quality are then used in the computer in which the antenna 300 is arranged. Signal quality is measured by known methods, such as the signal to noise ratio, SNR, or the carrier to interference ratio, C/I.

In a MIMO-system, one and the same frequency is usually used in order to transmit different information or data streams in different antenna beams, which explains the need for the beams of the antenna used in the invention to be orthogonal with respect to each other. The system can also be expanded and additional decorrelation obtained by letting the radiation elements have dual polarization, i.e. both vertical and horizontal polarization. In such a design, the antenna shown in FIG. 3 would in practice have not six but twelve beams.

The computer of the invention is assumed to be in a highly reflective environment such as, for example, an office environment. This means that the outputs of the antenna beams can be expected to retain their decorrelation between the computer and the second party (network base station, a second computer, etc) with which the computer communicates.

Figure 4:
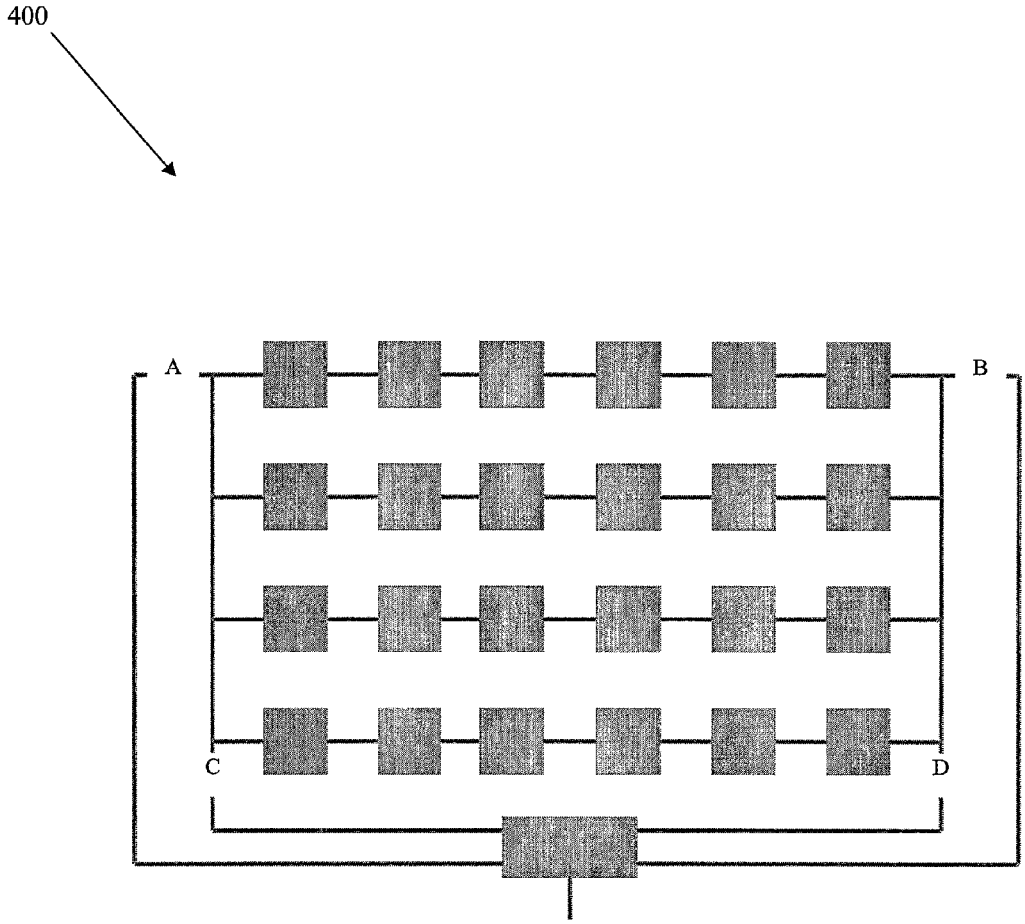

In FIG. 4, an alterative antenna 400 for use in a computer of the invention is shown. The main difference between the antenna 400 and the antenna 300 shown in FIG. 3 is that the antenna 300 comprises three one-dimensional travelling wave antennas, by means of which six beams (two from each antenna) can be created, which are all in the same elevational plane.

As opposed to the antenna 300, the antenna 400 in FIG. 4 comprises a plurality of one-dimensional arrays (suitably travelling wave arrays) which are also interconnected, thus creating a two dimensional array antenna. The two-dimensional array antenna is a well known concept to those skilled in the art, so it will not be described in detail here. However, one advantage offered by a two-dimensional array antenna is that the antenna beams can also be separated in the elevational plane, so that each of the one-dimensional array antennas comprised in the two-dimensional array antenna 400 may create four different beam directions.

Figure 5:
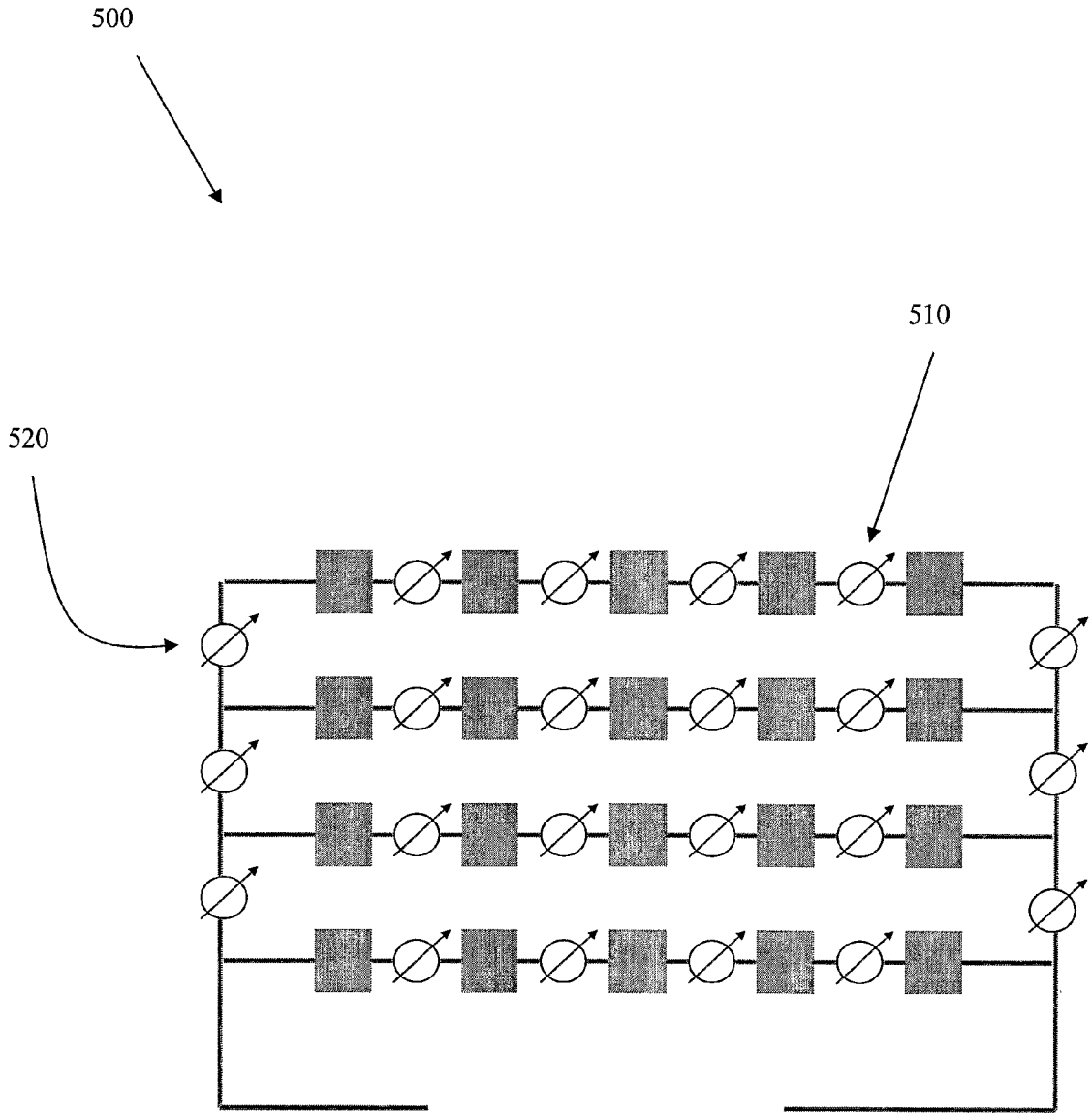

In FIG. 5, an alternative antenna 500 for use in the invention is shown. The antenna 500 is similar to that shown in FIG. 4, but in the antenna 500, variable phase shifters 510 are arranged between the radiation elements, as well as 520 on the connections which connect the different one-dimensional arrays to each other. The phase shifters can be used to steer the antenna beams adaptively, in a manner which as such is well known. The phase shifters 510 are used to steer the antenna beams in a first plane and the phase shifters 520 are used to steer the antenna beams in a second plane which is orthogonal to the first plane.

Figure 6:
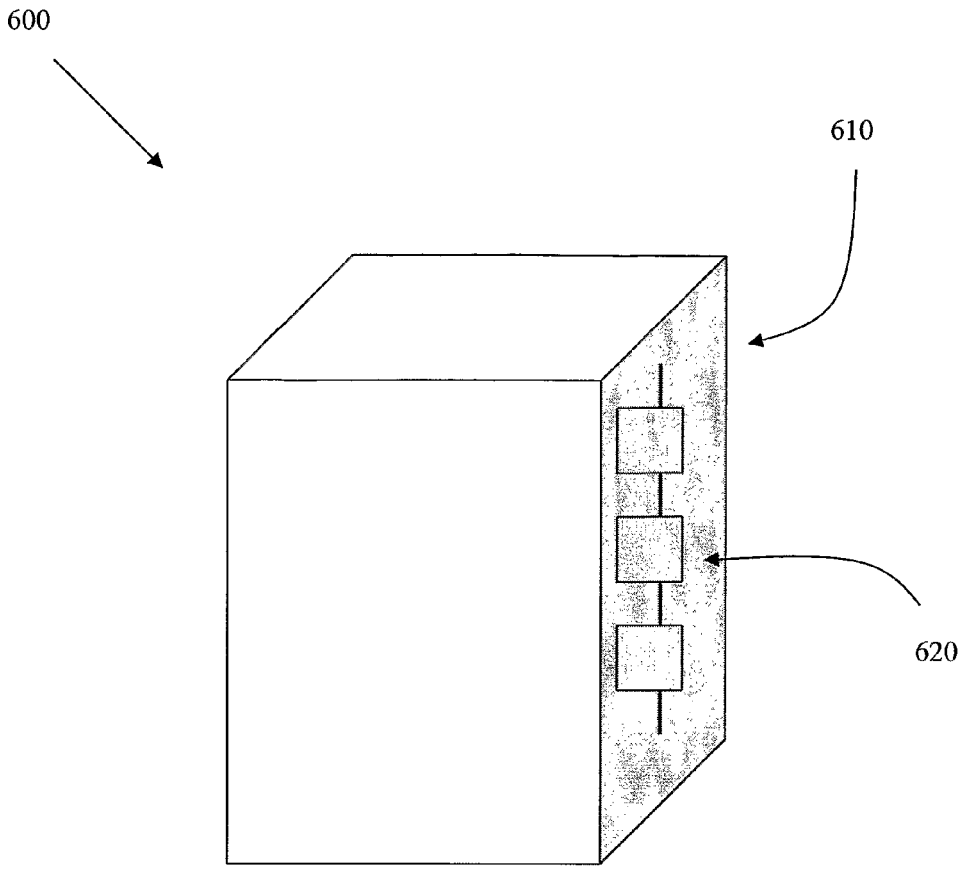

In FIG. 6, an alternative embodiment 600 of a computer according to the invention is shown. So far, the invention has been described as being implemented in a portable computer, but it may equally well be implemented in a personal computer of a more stationary kind, as shown in FIG. 6.

The computer 600 is thus intended for essentially stationary use, but may still be connected to a network or to other computers by wireless means. In such a computer, a first main surface which would be suitable for arranging an antenna on according to the invention would be one of the sides of the housing for the computer. Naturally, an alternative, which would also be valid for the portable computer, would be to arrange the antenna on a separate board which would be arranged inside the computer together with the other PCB's of the computer.

The antennas shown in FIGS. 1-6, in addition to the components shown, need a ground plane in order to function. Such a ground plane is suitably designed as a thin layer of an electrically reflecting material such as copper, spaced apart from the "antenna layer" by a dielectric material, and positioned behind the antenna layer, the word "behind" here being used with reference to the direction in which the antenna or antennas are intended to radiate.

As can also be mentioned here, the antenna itself can also suitably be etched in a conducting layer on a substrate, leaving a thin "antenna sheet" which may be incorporated in the electronics device as shown in this description. Thus, the antenna would be comprised of a first layer of a conducting material in which the radiation elements of the antenna have been shaped, and a second layer of a conducting material which constitutes a ground layer for the antenna elements, with the two layers being spaced apart by at least one layer of dielectric material.

The dielectric material can be more or less any such well known material, including air, i.e. the two layers could be spaced apart with only air between them.

The invention is not limited to that which has been shown above, but may be varied freely within the scope of the appended patent claims. For example, other array antennas than the travelling wave antenna may be used, such as for example Butler matrix antennas. In addition, the antenna may comprise radiation elements such as patches with individual phase control of each element.

Also, the array antenna may be placed on any surface, internal or external, on the electronics device which is sufficiently large for the antenna.

The invention claimed is:

1. An electronics device for personal use, comprising:

at least a first main surface; and at least a first antenna for communication via electromagnetic waves between the electronics device and a second party, wherein the antenna is an array antenna comprising at least a first and a second antenna element, and in that said array antenna is arranged on said first main surface, in which the antenna is a traveling wave antenna, and wherein the electronics device is a portable or a stationary computer.

2. An electronics device for personal use, comprising:

at least a first main surface; and at least a first antenna for communication via electromagnetic waves between the electronics device and a second party, wherein the antenna is an array antenna comprising at least a first and a second antenna element, and in that said array antenna is arranged on said first main surface, wherein the antenna is an array antenna with the elements arranged in a Butler matrix, and wherein the electronics device is a portable or a stationary computer.

3. An electronics device for personal use, comprising:

at least a first main surface; and at least a first antenna for communication via electromagnetic waves between the electronics device and a second party, wherein the antenna is an array antenna comprising at least a first and a second antenna element, and in that said array antenna is arranged on said first main surface, in which the antenna is a traveling wave antenna, and wherein the electronics device is a Personal Digital Assistant (PDA).

4. An electronics device for personal use, comprising:

at least a first main surface; and at least a first antenna for communication via electromagnetic waves between the electronics device and a second party, wherein the antenna is an array antenna comprising at least a first and a second antenna element, and in that said array antenna is arranged on said first main surface, wherein the antenna is an array antenna with the elements arranged in a Butler matrix, and wherein the electronics device is a Personal Digital Assistant (PDA).

5. An electronics device for personal use, comprising:

at least a first main surface; and at least a first antenna for communication via electromagnetic waves between the electronics device and a second party, wherein the antenna is an array antenna comprising at least a first and a second antenna element, said array antenna is arranged on said first main surface, and in which the antenna comprises a first and a second connection port, each of said ports being associated with one beam each of the antenna, wherein the antenna is a traveling wave antenna.

6. An electronics device for personal use, comprising:

at least a first main surface; and at least a first antenna for communication via electromagnetic waves between the electronics device and a second party, wherein the antenna is an array antenna comprising at least a first and a second antenna element, said array antenna is arranged on said first main surface, and in which the antenna comprises a first and a second connection port, each of said ports being associated with one beam each of the antenna, and wherein the antenna is an array antenna with the elements arranged in a Butler matrix.

* * * * *

UNITED STATES PATENT AND TRADEMARK OFFICE

CERTIFICATE OF CORRECTION

PATENT NO. : 7,639,191 B2
APPLICATION NO. : 11/994467
DATED : December 29, 2009
INVENTOR(S) : Andersson et al.

It is certified that error appears in the above-identified patent and that said Letters Patent is hereby corrected as shown below:

In Column 2, Line 34, delete "he" and insert -- the --, therefor.

Signed and Sealed this

Twenty-seventh Day of April, 2010

David J. Kappos

David J. Kappos
*Director of the United States Patent and Trademark Office*